US006742523B2

(12) United States Patent
Dubats

(10) Patent No.: US 6,742,523 B2
(45) Date of Patent: Jun. 1, 2004

(54) AMBULATOR AND GAIT HARNESS SYSTEM

(76) Inventor: David Edward Dubats, 2408 Ave. A, Bradenton Beach, FL (US) 34217

( * ) Notice: Subject to any disclaimer, the term of this patent is extended or adjusted under 35 U.S.C. 154(b) by 370 days.

(21) Appl. No.: 09/681,808

(22) Filed: Jun. 8, 2001

(65) Prior Publication Data

US 2002/0185137 A1 Dec. 12, 2002

(51) Int. Cl.[7] ..... A61G 15/00
(52) U.S. Cl. ..... 128/875; 482/66; 482/68
(58) Field of Search ..... 121/845, 874, 121/875; 482/66, 68, 69; 137/67; 602/36

(56) References Cited

U.S. PATENT DOCUMENTS 3,778,052 A * 12/1973 Andow ..... 272/70.4
4,312,505 A * 1/1982 Engelhart ..... 272/70.3
4,387,891 A * 6/1983 Knochel ..... 272/70.3
4,621,804 A * 11/1986 Mueller ..... 272/70.3
4,941,496 A * 7/1990 Berning ..... 135/67
5,526,893 A * 6/1996 Higer ..... 482/68
6,056,673 A * 5/2000 Arrecis ..... 482/66

* cited by examiner

*Primary Examiner*—Michael A. Brown
(74) *Attorney, Agent, or Firm*—Ronald E. Smith; Smith & Hopen, P.A.

(57) ABSTRACT

An ambulator for assisting an individual in walking or standing includes a three-sided base disposed in close proximity to a support surface and a three-sided support structure that is mounted to the base by a pair of transversely spaced apart support posts. The support posts are telescopically constructed so that the support structure is adjustable to the comfort of the individual. The individual is fitted with a harness and the harness is secured to the support structure by a plurality of straps. The harness and a brake for the ambulator ensures that the individual cannot fall even when the individual is supported only by the ambulator and the harness. The harness also provides a seat.

16 Claims, 3 Drawing Sheets

AMBULATOR AND GAIT HARNESS SYSTEM

BACKGROUND OF THE INVENTION

1. Field of the Invention

This invention relates, generally, to devices that facilitate the task of a care giver such as a physical therapist when helping patients perform standing or walking exercises. More particularly, it relates to a gait harness that is worn by the patient and an ambulator to which the gait harness may be attached.

2. Description of the Prior Art

Patients who need assistance in walking or standing are typically assisted by three people a physical therapist and two physical therapist assistants. The physical therapist and one physical therapist assistant stand on opposite sides of the patient and hold the patient. A third person walks behind the patient with a wheel chair because the patient may tire quickly and require seating.

Hospitals, nursing homes, assisted living facilities, and other such institutions are often understaffed and the members of the staff are therefore overworked and lack sufficient time to give each patient the attention they require. When three people are required to help one patient walk a short distance, it is obvious that other patients are not being helped.

What is needed, then, is a standing or walking aid that assists a patient in standing or walking, and which reduces the number of personnel required to assist such patient.

However, in view of the prior art considered as a whole at the time the present invention was made, it was not obvious to those of ordinary skill in the pertinent art how the identified needs could be fulfilled.

SUMMARY OF INVENTION

The longstanding but heretofore unfulfilled need for an apparatus that reduces the number of care givers required to help a patient stand or walk so that the quality of care could be increased for that patient and other patients is now met by a new, useful, and nonobvious ambulator. The novel ambulator is intended for use on a substantially horizontal support surface. It includes a first base rail of straight configuration and elongate extent. The first base rail has a leading end and a trailing end and is disposed in a substantially horizontal plane. A first pair of longitudinally spaced apart wheels supports the first base rail. More particularly, a first forward wheel is disposed near a leading end of the first base rail and a first rear wheel is disposed near a trailing end thereof. A first support post is mounted to the first base rail in upstanding relation thereto and a first arm support is disposed in surmounting relation to the first support post. The first arm support is disposed substantially parallel to the first base rail. A second base rail is disposed in parallel, transversely spaced apart relation to the first base rail and has the same construction as the first base rail. A second pair of longitudinally spaced apart wheels support the second base rail. The second pair of wheels includes a second forward wheel disposed near a leading end of the second base rail and a second rear wheel disposed near a trailing end of the second base rail. A second support post is mounted to the second base rail in upstanding relation thereto and a second arm support is disposed in surmounting relation to the second support post. The second arm support is substantially parallel to the second base rail.

A first transversely disposed rod is disposed in interconnecting relation between respective leading ends of the first and second arm supports and defines a forward end of the ambulator. The first and second base rails, the first and second arm supports, and the first transversely disposed rod collectively form a square "U"-shaped three-sided enclosure within which an individual requiring assistance in standing and walking is positioned.

A second transversely disposed rod is disposed in interconnecting relation between respective leading ends of the first and second base rails. This second rod is disposed in leading relation to the first transversely disposed rod so that the feet of the individual using the ambulator as a walking aid may travel beyond the forward end of the ambulator without hitting the second transversely disposed rod.

A harness member is worn by the patient at all times when ambulator 10 is in use. The harness member includes a belt-like base that snugly fits around the waist of the patient. A plurality of spaced apart loops are secured to the base along the length thereof and a corresponding plurality of loops are secured to the arm supports. A plurality of straps interconnect the harness to the arm supports. More particularly, the radially innermost end of each strap is releasably secured to a preselected loop of the belt-like base and the radially outermost end of each strap is releasably connected to a preselected loop of a preselected arm support. The straps are pulled taut so that movement of the patient effects simultaneous and corresponding movement of the ambulator. The harness thus supports the patient when walking or standing. Significantly, when the patient tires, the harness provides a seat that comfortably supports the patient, thereby obviating the need for a wheelchair and a wheelchair operator. After resting, the patient can resume walking or standing without the intervention of a care giver.

The support posts are of telescopic construction so that the height of the ambulator may be adjusted to accommodate patients of varying heights.

A unique braking means is also provided. A pair of transversely spaced apart posts depend from the second transverse rod that forms a part of the base assembly of the ambulator. A bias means is positioned above each of the forward wheels of the ambulator so that the posts are vertically spaced above the support surface when the bias means are in repose. If a patient falls forwardly while walking, thereby applying downward pressure to the first transverse rod, the bias members are compressed and the posts engage the support surface, thereby preventing forward travel of the ambulator until pressure has been removed from said transverse bar.

A third transversely disposed rod is disposed in interconnecting relation between respective trailing ends of the first and second arm supports. This third rod serves to close the square "U"-shaped enclosure when a patient is lifted into the enclosure by a lift or crane means. In that circumstance, the patient is facing in the opposite direction as those patients who enter the walker under their own power. The third transversely disposed rod performs the function of the first transversely disposed rod when the user is facing rearwardly.

A primary object of the invention is to provide an apparatus that reduces from three to one the number of people required to assist a patient who needs assistance in standing or walking.

A closely related object is to attain the foregoing object with an apparatus that prevents a patient from falling even when the patient is not being held by a physical therapist.

These and other important objects, advantages, and features of the invention will become clear as this description proceeds.

The invention accordingly comprises the features of construction, combination of elements, and arrangement of parts that will be exemplified in the description set forth hereinafter and the scope of the invention will be indicated in the claims.

BRIEF DESCRIPTION OF DRAWINGS

For a fuller understanding of the nature and objects of the invention, reference should be made to the following detailed description, taken in connection with the accompanying drawings, in which.

DETAILED DESCRIPTION

Figure 1:
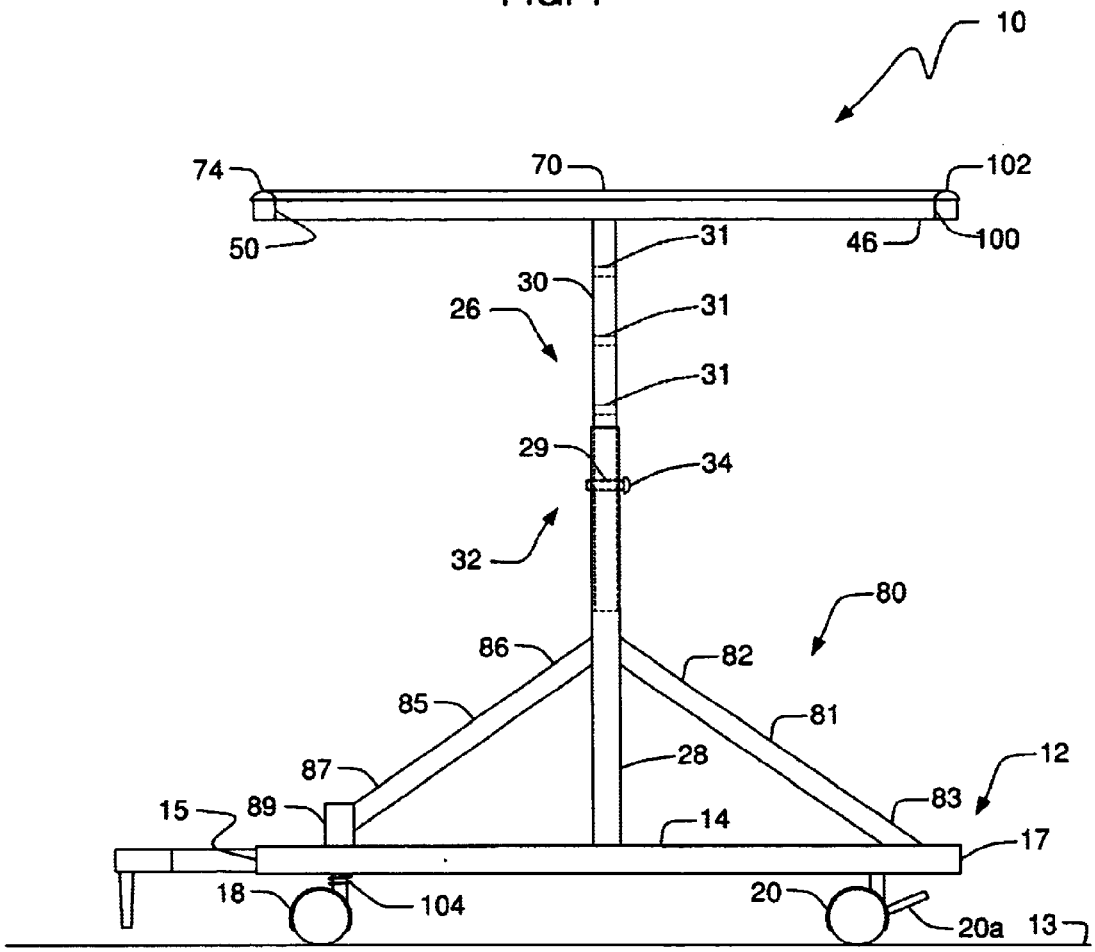
FIG. 1 is a side elevational view of an illustrative embodiment of the invention.
Figure 2:
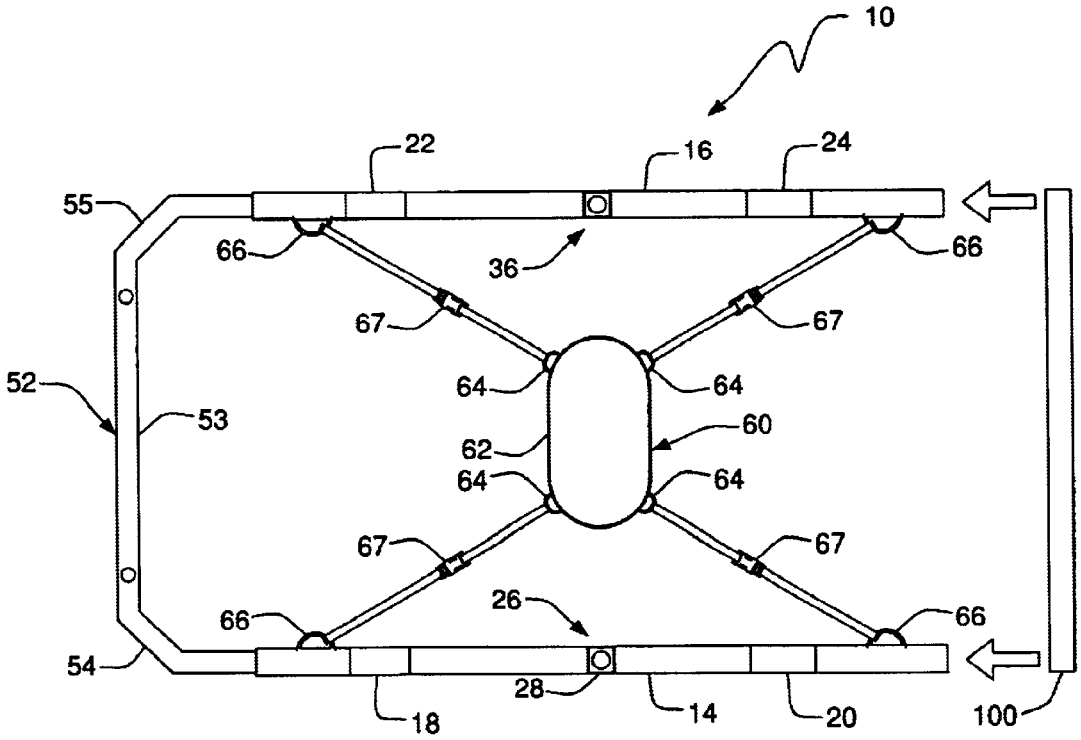
FIG. 2 is a top plan view thereof, but with the arm supports removed so that the base of the ambulator may be seen.
Figure 3:
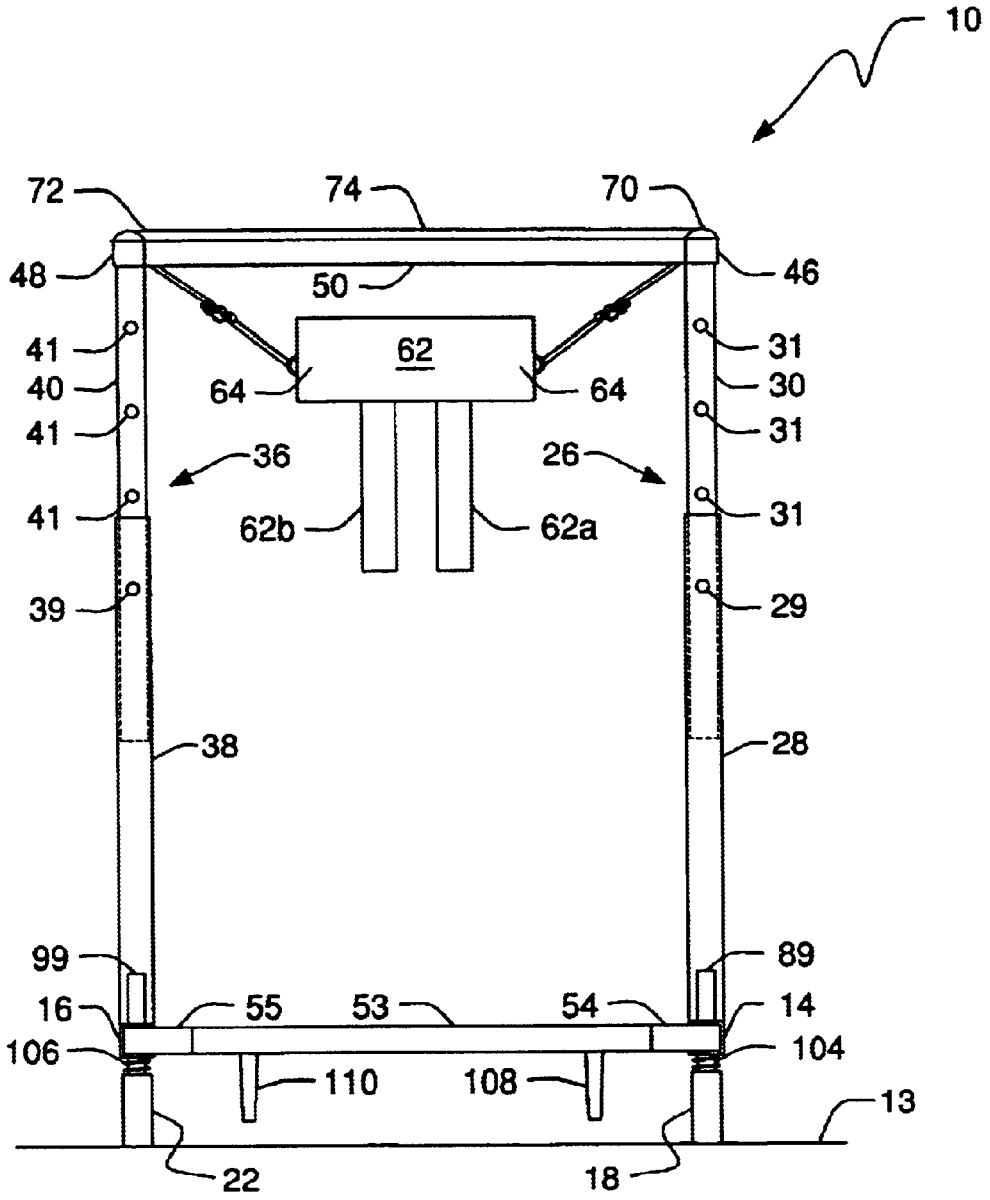
FIG. 3 is a front elevational view thereof.

Referring to FIGS. 1–3, it will there be seen that the reference numeral 10 denotes an illustrative embodiment of the present invention.

Ambulator 10 includes a three-sided base 12 that is positioned in relatively closely spaced relation, such as a few inches, to a horizontal support surface 13. Base 12 includes first base rail 14 and second base rail 16.

First base rail 14 is supported by a pair of caster wheels denoted 18, 20. First wheel 18 is positioned near leading end 15 of first base rail 14 and second wheel 20 is positioned near trailing end 17 of said first base rail. Tab 20*a* that projects from rear wheel 20 activates a well-known braking means when stepped upon so that caster wheel 10 cannot roll and hence ambulator 10 cannot move when said braking means is activated.

Second base rail 16 is parallel to and transversely spaced apart from first base rail 14. It is supported by a pair of caster wheels denoted 22, 24. First wheel 22 is positioned near the leading end of second base rail 16 and second wheel 24 is positioned near the trailing end of said second base rail.

First support post 26 is mounted to first base rail 14 in upstanding relation thereto, about mid-length thereof. Post 26 includes a lower housing 28 that telescopically receives tubular member 30. Lower housing 28 has a horizontal throughbore 29 formed therein and tubular member 30 has a plurality of vertically spaced apart throughbores formed therein, collectively denoted 31. Lock member 32 has a throughbore-engaging shaft 33 and a handle 34 as depicted and operates in a well-known way to hold tubular member 30 in a preselected position of adjustment relative to lower housing 28.

Second support post 36 is mounted to second base rail 16 in upstanding relation thereto, about mid-length thereof. Post 36 includes a lower housing 38 that telescopically receives tubular member 40. Lower housing 38 has a throughbore 39 formed therein and tubular member 40 has a plurality of vertically spaced apart throughbores formed therein, collectively denoted 41. Lock member 42, not shown, has the same structure as lock member 32, including a throughbore-engaging shaft 43, not shown, and a handle 44, not shown and operates in the same way as lock member 32 to hold tubular member 40 in a preselected position of adjustment relative to lower housing 38.

First arm support 46 is disposed in surmounting relation to first support post 26 and in parallel relation to first base rail 14. Second arm support 48 is disposed in surmounting relation to second support post 36 and in parallel relation to second base rail 16.

A first transversely disposed rod 50 is disposed in interconnecting relation between respective leading ends of said first and second arm supports 46, 48 and defines a forward end of ambulator 10.

A second transversely disposed rod 52 is disposed in interconnecting relation between respective leading ends of the first and second base rails 14, 16. Rod 52 is disposed in leading relation to first transversely disposed rod 50 so that the feet of an individual using ambulator 10 as a walking aid may travel beyond the forward end of the ambulator without hitting rod 52. Rod 52 includes a straight middle section 53, a first end section 54 secured to a first end of said straight middle section, and a second end section 55 secured to a second end of straight middle section 53. The first and second end sections are disposed at a common angle relative to straight middle section 53. The first end section has a trailing end secured to a leading end of first base rail 14 and the second end section has a trailing end secured to a leading end of second base rail 16.

Harness 60 is adapted to be worn by the individual requiring assistance. Harness 60 includes a belt-like base 62 of adjustable length adapted to fit snugly around the individual's waist. A first plurality of loop members 64 are secured to base 62 along its extent and a second plurality of loop members 66 are secured to first and second arm supports 46, 48 A plurality of straps 68 interconnects harness 60 to ambulator 10. More particularly, each strap has a first end releasably secured to a preselected loop member of said first plurality of loop members 64 and has a second end releasably secured to a preselected loop member of said second plurality of loop members 66. Each strap of the plurality of straps is adjustable in length and includes a locking and quick release unlocking means 67. Each strap of said plurality of straps is taut when an individual is using ambulator 10 so that movement of the individual simultaneously produces a corresponding movement of the ambulator.

Leg straps 62*a*, 62*b* depend from base 62 and include means, not shown, for securing said straps to the legs of the ambulator user. The full details of construction of harness 60 are provided in U.S. Pat. No. 5,893,367 entitled Therapeutic Gait Harness and Pelvic Support System, to the present inventor and others, which disclosure is hereby incorporated hereinto by reference.

Padding means 70, 72 is secured to said arm supports 46, 48 in overlying relation thereto, respectively, to increase the comfort of the individual using the ambulator. A padding means 74 is likewise secured to first transversely disposed rod 50 in overlying relation thereto to increase the comfort of the user. Arm supports 46, 48 are adjusted in height so that the forearms of the user are supported by padding 70, 72 when the shoulders of the user are relaxed.

A first brace means 80 includes first brace member 81 having a forward end 82 secured to first support post 26 at a preselected location in vertically spaced relation to a lowermost end of said first support post and a rearward end 83 secured to a trailing end of first base rail 14. First brace means 80 further includes a second brace member 85 having a rearward end 86 secured to first support post 26 at a preselected location in vertically spaced relation to a lowermost end thereof and a forward end 87 secured to housing 89 that is mounted on a leading end of first base rail 14 in upstanding relation thereto. Housing 89 receives the uppermost end of a bias means 104, disclosed hereinafter.

A second brace means 90, not shown, has the same structure as brace means 80 but provides the function of supporting second support post 36. It includes a first brace member, not shown, having a forward end secured to second support post 36 at a preselected location in vertically spaced relation to a lowermost end of said second support post and a rearward end secured to a trailing end of second base rail 16. A second brace member, not shown, has a rearward end secured to second support post 36 at a preselected location in vertically spaced relation to a lowermost end of second support post and a forward end secured to a bias mean-receiving housing 99 mounted to the leading end of second base rail 16 in upstanding relation thereto.

Third transversely disposed rod 100 is disposed in interconnecting, detachable relation between respective trailing ends of the first and second arm supports 46, 48. Third transversely disposed rod 100 defines a rearward or trailing end of ambulator 10. Padding means 102 is secured to rod 100 in overlying relation thereto to increase the comfort of the user.

A first bias means 104 is disposed in biasing relation between the leading end of first base rail 14 and first forward wheel 18 and a second bias means 106 is disposed in biasing relation between the leading end of the second base rail 16 and second forward wheel 22. The first and second bias means are under compression when the user applies weight to first transversely disposed rod 50.

Rigid posts 108, 110 are secured to middle section 53 of second transversely disposed rod 52 in transversely spaced apart relation to one another and in depending relation to said second transversely disposed rod. The rigid posts have a common preselected length that spaces respective lowermost ends of the rigid posts slightly above support surface 13 when the first and second bias means 104, 106, respectively, are in repose. Posts 108, 110 engage the support surface and prevent forward motion of ambulator 10 when first and second bias means 104, 106 are compressed by the individual applying weight to first transversely disposed rod 50.

It will thus be seen that the objects set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed:

1. An ambulator intended for use on a substantially horizontal support surface, comprising:

a first base rail of straight configuration and elongate extent, said first base rail having a leading end and a trailing end and said first base rail disposed in a substantially horizontal plane;

a first pair of longitudinally spaced apart wheels for supporting said first base rail, said first pair of wheels including a first forward wheel disposed near a leading end of said first base rail and a first rear wheel disposed near a trailing end of said first base rail;

a first support post mounted to said first base rail, mid-length thereof, in upstanding relation thereto;

a first arm support disposed in surmounting relation to said first support post, said first arm support being substantially parallel to said first base rail and said first arm support being supported at mid-length by said first support post;

a second base rail of straight configuration and elongate extent, said second base rail having a leading end and a trailing end and said second base rail disposed in a substantially horizontal plane;

a second pair of longitudinally spaced apart wheels for supporting said second base rail, said second pair of wheels including a second forward wheel disposed near a leading end of said second base rail and a second rear wheel disposed near a trailing end of said second base rail;

a second support post mounted to said second base rail, mid-length thereof, in upstanding relation thereto;

a second arm support disposed in surmounting relation to said second support post, said second arm support being substantially parallel to said second base rail and said second arm support being supported at mid-length by said second support post;

a first transversely disposed rod disposed in interconnecting relation between respective leading ends of said first and second support arms, said first transversely disposed rod defining a forward end of said ambulator; and said first and second base rails, said first and second arm supports, and said first and second transversely disposed rods collectively forming a three-sided enclosure within which an individual requiring assistance in standing and walking is positioned.

2. The ambulator of claim 1, further comprising a second transversely disposed rod disposed in interconnecting relation between respective leading ends of said first and second base rails, said second transversely disposed rod being disposed in leading relation to said first transversely disposed rod so that the feet of said individual using said ambulator as a walking aid may travel beyond said forward end of said ambulator without hitting said second transversely disposed rod.

3. The ambulator of claim 2, wherein said second transversely disposed rod includes a straight middle section, a first end section secured to a first end of said straight middle section, a second end section secured to a second end of said straight middle section, said first and second end sections being disposed at a common angle relative to said straight middle section, said first end section having a trailing end secured to a leading end of said first base rail and said second end section having a trailing end secured to a leading end of said second base rail.

4. The ambulator of claim 2, further comprising a first bias means disposed in biasing relation between said leading end of said first base rail and said first forward wheel and a second bias means disposed in biasing relation between said leading end of said second base rail and said second forward wheel, said first and second bias means being under compression when said individual applies weight to said first transversely disposed rod.

5. The ambulator of claim 4, further comprising a pair of rigid posts secured to said second transversely disposed rod in transversely spaced apart relation to one another and in depending relation to said second transversely disposed rod, said pair of rigid posts having a common preselected length, said preselected length spacing respective lowermost ends of said rigid posts slightly above said support surface when said first and second bias means are in repose and said rigid posts engaging said support surface and thereby preventing forward motion of said ambulator when said first and second bias means are compressed by said individual applying weight to said first transversely disposed rod.

6. The ambulator of claim 1, further comprising:

a harness adapted to be worn by said individual requiring assistance;

said harness including a belt-shape base of adjustable length adapted to fit snugly around said individual's waist;

said belt-shape base including a first plurality of loop members secured thereto along the extent of said belt-shape base;

a second plurality of loop members secured to said first and second support arms;

a plurality of straps, each strap having a first end releasably secured to a preselected loop member of said first plurality of loop members and having a second end releasably secured to a preselected loop member of said second plurality of loop members;

whereby said individual is supported in a standing position by said plurality of straps.

7. The ambulator of claim 6, wherein each strap of said plurality of straps is adjustable in length and includes a locking means and a quick release unlocking means, and wherein each strap of said plurality of straps is taut when said individual is using said ambulator so that movement of said individual simultaneously produces a corresponding movement of the ambulator.

8. The ambulator of claim 1, further comprising padding means secured to said first and second arm supports in overlying relation thereto to increase the comfort of said individual using said ambulator.

9. The ambulator of claim 1, further comprising padding means secured to said first transversely disposed rod in overlying relation thereto to increase the comfort of said individual using said ambulator.

10. The ambulator of claim 1, wherein said first and second support posts have a telescoped construction so that said first and second arm supports may be adjusted in height to accommodate individuals of varying height, said telescoped construction including means for locking said first and second support posts in a plurality of positions of adjustments.

11. The ambulator of claim 1, further comprising first brace means for bracing said first support post and second brace means for bracing said second support post.

12. The ambulator of claim 11, wherein said first brace means includes a first brace member having a forward end secured to said first support post at a preselected location in vertically spaced relation to a lowermost end of said first support post and a rearward end secured to a trailing end of said first base rail and a second brace member having a rearward end secured to said first support post at a preselected location in vertically spaced relation to a lowermost end of said first support post and a forward end secured to a leading end of said first base rail.

13. The ambulator of claim 12, wherein said second brace means includes a first brace member having a forward end secured to said second support post at a preselected location in vertically spaced relation to a lowermost end of said second support post and a rearward end secured to a trailing end of said second base rail and a second brace member having a rearward end secured to said second support post at a preselected location in vertically spaced relation to a lowermost end of said second support post and a forward end secured to a leading end of said second base rail.

14. The ambulator of claim 1, further comprising a third transversely disposed rod, said third transversely disposed rod disposed in interconnecting relation between respective trailing ends of said first and second support arms, said third transversely disposed rod defining a rearward end of said ambulator.

15. The ambulator of claim 14, wherein said third transversely disposed rod is reasonably attached to respective trailing ends first and second support posts.

16. The ambulator of claim 15, further comprising padding means secured to said third transversely disposed rod in overlying relation thereto to increase the comfort of said individual using said ambulator.

* * * * *